US011377838B2

(12) United States Patent
Jackson

(10) Patent No.: US 11,377,838 B2
(45) **Date of Patent: *Jul. 5, 2022**

(54) BUILDING CONSTRUCTION METHOD

(71) Applicant: Iavilaer Proprietary Limited, Forrestfield (AU)

(72) Inventor: Ian Jackson, Forrestfield (AU)

(73) Assignee: Iavilaer Proprietary Limited, Forrestfield (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/007,182

(22) Filed: Aug. 31, 2020

(65) Prior Publication Data

US 2020/0399886 A1 Dec. 24, 2020

Related U.S. Application Data

(63) Continuation of application No. 16/328,977, filed as application No. PCT/AU2018/050977 on Sep. 10, 2018, now Pat. No. 10,822,786.

(30) Foreign Application Priority Data

Sep. 12, 2017 (AU) ..... 2017903701
May 10, 2018 (AU) ..... 2018901613

(51) Int. Cl.

| | |
|---|---|
| ***E04B 1/16*** | (2006.01) |
| ***E04B 1/20*** | (2006.01) |
| ***E04B 1/24*** | (2006.01) |
| ***E04B 2/58*** | (2006.01) |
| ***E04B 5/38*** | (2006.01) |
| ***E04C 3/40*** | (2006.01) |

(52) U.S. Cl.

CPC ..... *E04B 1/165* (2013.01); *E04B 1/20* (2013.01); *E04B 1/2403* (2013.01); *E04B 2/58* (2013.01); *E04B 5/38* (2013.01); *E04C 3/40* (2013.01); *E04B 2001/246* (2013.01)

(58) Field of Classification Search

CPC ..... E04B 1/165; E04B 1/20; E04B 1/2401; E04B 1/3505; E04B 1/3522; E04B 1/3511; E04B 2001/2439; E04B 5/38

See application file for complete search history.

(56) References Cited

U.S. PATENT DOCUMENTS 2,966,718 A * 1/1961 Dave ..... E04G 11/48 264/33
3,127,961 A * 4/1964 Frazier ..... A47B 96/1408 52/633
3,831,902 A * 8/1974 Vanderklaauw ..... E04B 1/3505 254/105

(Continued)

FOREIGN PATENT DOCUMENTS

WO WO-2006058391 A1 * 6/2006 ..... E04C 3/34

*Primary Examiner* — Christine T Cajilig
(74) *Attorney, Agent, or Firm* — Bond Schoeneck & King, PLLC; George McGuire

(57) ABSTRACT

A building construction method uses wall frames having a moveable top track. The track is fixed in a raised position so as to be load-bearing during construction, allowing construction work to progress quickly. When supporting concrete columns have cured, the fixing can be released allowing the track to move into a lowered position and for the building load to transfer to the columns.

12 Claims, 9 Drawing Sheets

(56) References Cited

U.S. PATENT DOCUMENTS

| | | | | | |
|---|---|---|---|---|---|
| 3,999,350 | A * | 12/1976 | MacKenzie | A47B 96/1408 | 52/633 |
| 4,081,935 | A * | 4/1978 | Wise | E04B 1/21 | 52/236.8 |
| 4,363,200 | A * | 12/1982 | Goldenberg | E04C 3/20 | 52/251 |
| 4,869,040 | A * | 9/1989 | Howell | E04B 1/24 | 52/633 |
| 5,412,919 | A * | 5/1995 | Pellock | E04B 2/60 | 52/241 |
| 10,260,224 | B1 * | 4/2019 | Jazzar | E04B 1/164 | |
| 2001/0003234 | A1 * | 6/2001 | Van Doren | E04C 3/20 | 52/251 |
| 2010/0058687 | A1 * | 3/2010 | Normand | E04B 1/165 | 52/236.3 |
| 2012/0266545 | A1 * | 10/2012 | diGirolamo | E04B 1/38 | 52/98 |
| 2019/0127966 | A1 * | 5/2019 | Stewart | E04B 1/165 | |

* cited by examiner

BUILDING CONSTRUCTION METHOD

CROSS REFERENCE TO RELATED APPLICATION

The present application is a continuation of and claims priority to U.S. application Ser. No. 16/328,977, filed Feb. 27, 2019, now allowed, which is the United States National Stage entry of PCT/AU2018/050977, filed Sep. 10, 2018, which claims priority to Australian application No. AU2017903701, filed Sep. 12, 2017, and Australian application No. AU2018901613, filed May 10, 2018 the entirety of each of which is hereby incorporated by reference

FIELD OF THE INVENTION

The present invention relates to the construction of buildings. It has been devised as a method for construction of multi-story buildings, with particular application to buildings with more than two stories.

BACKGROUND TO THE INVENTION

Building regulations in some countries require that, in general, a building of more than three stories must have its load bearing walls made of concrete or masonry. These regulations are due to fire resistance requirements. It is possible to construct a building with loads carried by steel or timber frames which is structurally sound, however such frames can be significantly weakened by fire.

Buildings constructed using masonry are generally built gradually from the ground up, in courses. Beyond a certain level, it is necessary for grout in the masonry to cure before further loads are applied. In practice, this means that each story must be allowed to cure before construction of a higher story begins.

Buildings constructed using precast concrete can be built more quickly. Nonetheless, they can still require the individual panels to be connected to each other, typically by grouting. In addition to the inherent expense and difficulty in using precast panels (notably transport and movement costs associated with heavy panels) the use of such panels still has considerable 'wait' time associated with it.

In recent years, it has become more common to construct buildings using a system of 'permanent formwork', whereby the building walls are laid out using lightweight, hollow wall panels, and concrete is then poured into the panels and allowed to cure to provide structural strength. While the costs of transporting and moving such panels is considerably less than using precast concrete, the system requires complete curing of the concrete within the panels of each level before a floor can be placed upon it.

All of the above systems have the further limitation that, in general, it is necessary to wait until the load bearing walls and columns have been secured and, where necessary, cured before fixing internal walls within the structure. Indeed, often it is necessary to complete the entire load-bearing structure of a building before non load-bearing walls can be located.

US patent application number 2010/0058687 describes a system of permanent formwork as described above, with the formwork partially supporting loads being placed above it. Following curing of the concrete columns, the load is shared by the concrete and the permanent formwork.

The present invention proposes an alternative construction system which seeks to alleviate some of these limitations, at least in part.

For the avoidance of doubt, the term 'columns' as used herein broadly encompasses vertical load bearing building elements; including traditional columns having a relatively even length:width ratio, blade columns, and blade walls where the length may be much greater than the width.

SUMMARY OF THE INVENTION

According to one aspect of the present invention there is provided a method of constructing a building, the method including the steps of:

- forming a building frame, the frame including a plurality of vertical channels, the frame being sufficiently strong to bear load from at least one higher story, the frame defining a load path for the load of the at least one higher story;
- at least partially forming at least one higher story;
- filling the channels with a curable substance;
- allowing the curable substance in the channels to cure and to form columns within the building; and
- creating a break in the load path of the frame and thus transferring the load from the at least one higher story from the building frame to the cured columns.

It will be appreciated that the transfer of load from the building frame to the cured columns is complete, with none of the final load being carried by the frame.

It will also be appreciated that building frame will bear a significant proportion of the load of the higher story, but may not bear the entire load. In some instances, the present invention envisages sharing the entire load of the higher story between the building frame and some temporary props. It will be understood the required number and load capacity of the temporary props will be substantially reduced when used in conjunction with the present invention.

Advantageously, this allows for building to continue while the columns cure, with the load of higher stories being borne by the building frame. On completion of the building, the cured columns become the load bearing members preferentially to the frame, thus meeting the requirements of the building codes.

It is preferred that the building frame is formed from structural steel. In a preferred embodiment the building frame is formed of cold-rolled section steel with a nominal thickness in the order of between 0.75 mm and 1.6 mm.

It is preferred that the curable substance is concrete.

Preferably, the method includes the step of locating deck formwork atop the building frame, with the channels fluidly connected to the deck formwork. The step of filling the channels with the curable substance can then occur at the same time as the curable substance is poured into formwork to complete a floor surface above the building frame.

It is preferred that at least some main internal wall frames are located at the same time that external wall frames are located. For instance, when apartments are being constructed frames for separating walls can be included. It is possible for the walls of an entire level to be completed at the same time, although this is not always desirable as it may make inspection difficult. The use of internal wall frames permits access for internal fitout of lower floors while higher floors are being constructed.

The building frame preferably includes vertical studs and horizontal tracks. The building frame preferably includes a load transfer means created by securing one track, preferably a top-most track, to the studs using at least one removable fixing member. The step of creating a break in the load path may be achieved by removal of the fixing member(s).

Alternatively, the building frame may include a shear head arranged to shear at a load greater than that of a single higher story but less than the entire structure at its completed load. In this embodiment the break in the load path may be effected by allowing the shear head to shear following curing of the columns, resulting in vertical loads being taken by the columns rather than by the frame.

According to a second aspect of the present invention there is provided a wall frame component including vertical studs and horizontal tracks, the wall frame having a top-most track moveable between a relatively raised position and a relatively lowered position, the wall frame including removable fixing members which maintain the top-most track in its raised position, whereby removal of the fixing members allows the top-most track to move into its lowered position.

When the top-most track is in its relatively raised position, the wall frame component preferably includes a load path transferring load from the top-most track to the vertical studs via at least one removable fixing member. It will be appreciated that removal of the fixing members causes a break in the load path.

The top-most track may include apertures which are arranged to align with corresponding apertures in the vertical studs when the top-most track is in its relatively lowered position. In this way the top-most track may be fixed in its relatively lowered position by the use of fasteners if desired.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
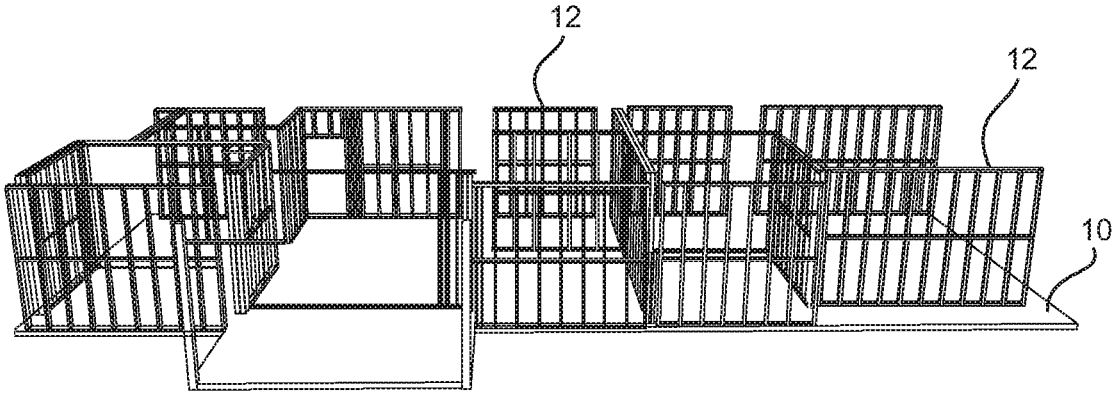
FIGS. 1 to 6 are sequential schematic views of a portion of a multi-story building being constructed in accordance with the present invention.

Referring to the Figures, FIG. 1 shows a schematic view of one level of a multi-story building. The level includes a base slab 10, upon which wall frames 12 are arranged. The wall frames 12 in this embodiment have been arranged to form the layout of internal and external walls above the slab 10.

The wall frames 12 are formed from cold-rolled steel section. Typical wall thicknesses are in the order of 90 mm. The steel is typically between 0.75 mm and 1.6 mm nominal thickness. The wall frames 12 are constructed so as to be able to bear relatively high vertical loads.

Figure 2:
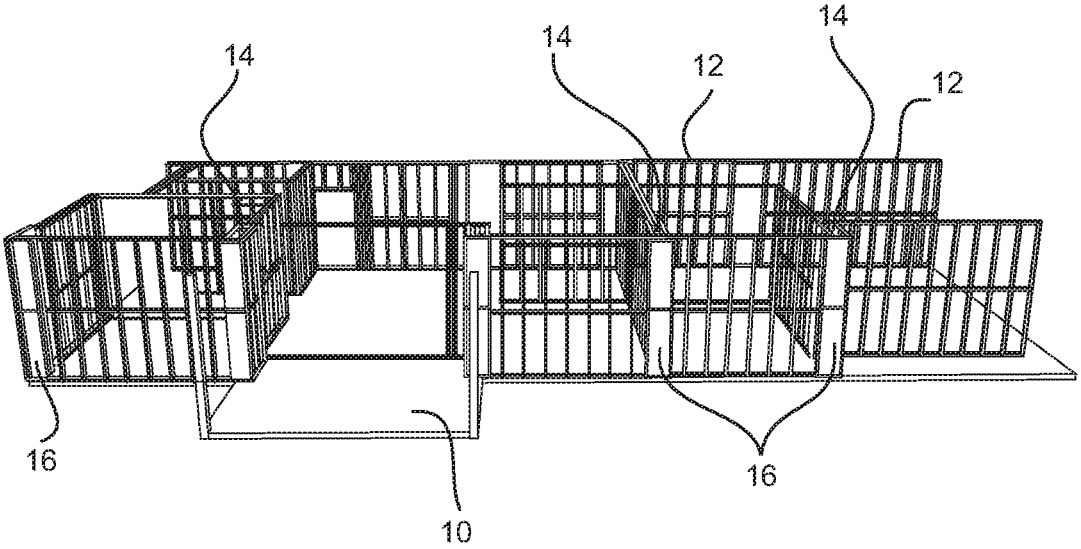

The wall frames 12 are arranged such that vertical channels 14 can be located at desired intersections. The channels 14 are created by the use of column shutters 16 located at the desired locations, as shown in FIG. 2. The vertical channels 14 are generally rectangular in cross section, and are sized such that when filled with concrete to form columns the concrete columns have a greater vertical load capacity than the wall frames 12.

Figure 3:
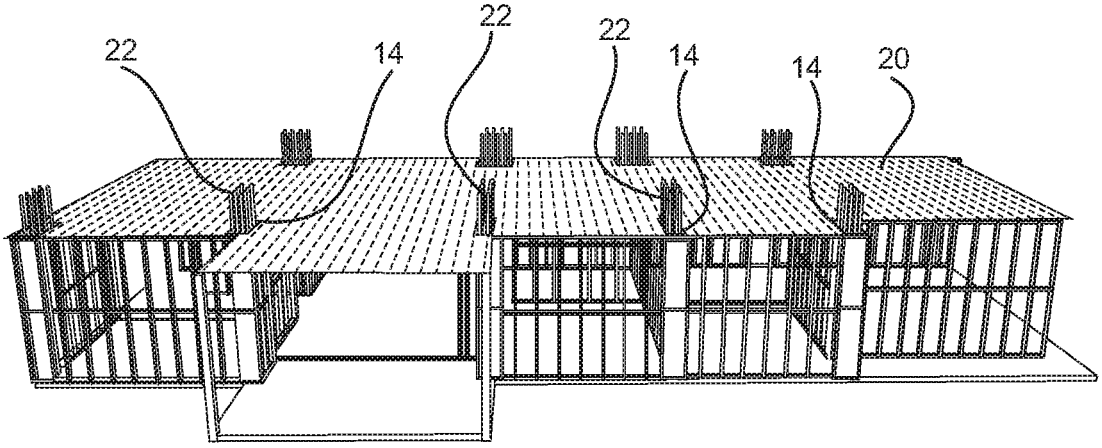

Once the wall frames 12 and the column shutters 16 are in position, a framework deck 20 can be fixed atop the wall frames 12, with appropriate reinforcing in place. The framework deck 20 is arranged such that voids in the deck 20 locate over the openings to the vertical channels 14. Reinforcing rods 22 are positioned within the vertical channels 14, extending above the deck 20. This can be seen in FIG. 3. If required, additional temporary props can be installed beneath the deck 20.

Figure 4:
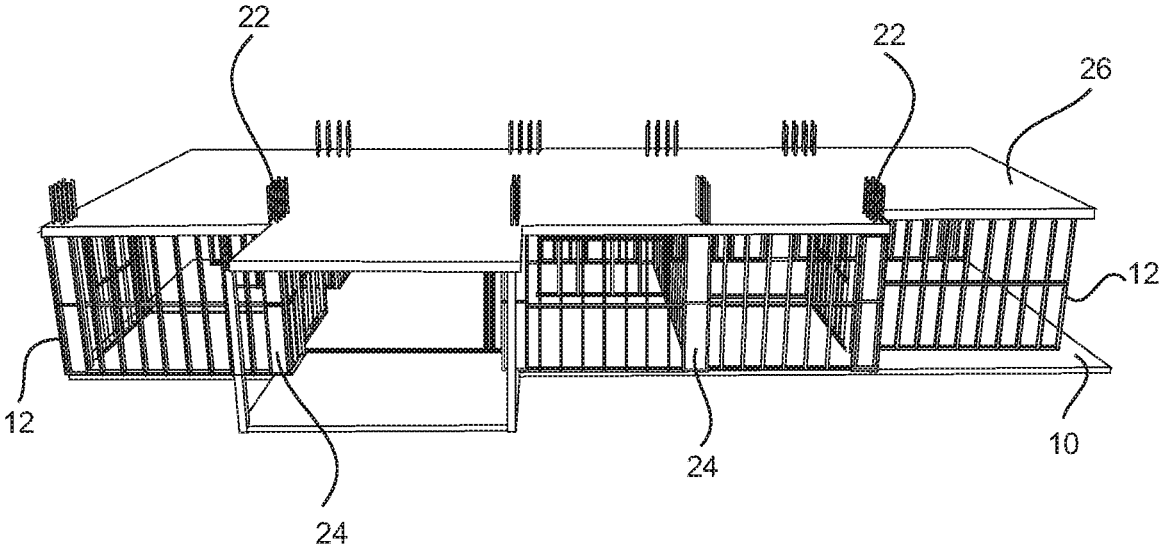
Figure 5:
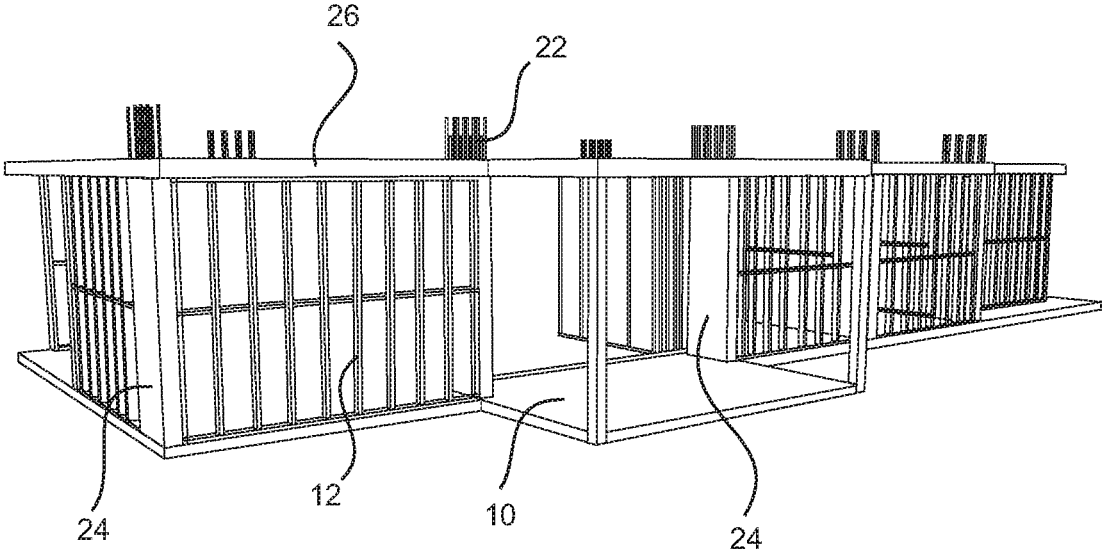

Concrete can then be poured to simultaneously form columns 24 within the vertical channels 14 and a suspended slab 26. The wall frames 12 are sufficiently strong to take the weight of the suspended slab 26, either on their own or in conjunction with temporary props. This is shown in FIGS. 4 and 5.

Figure 6:
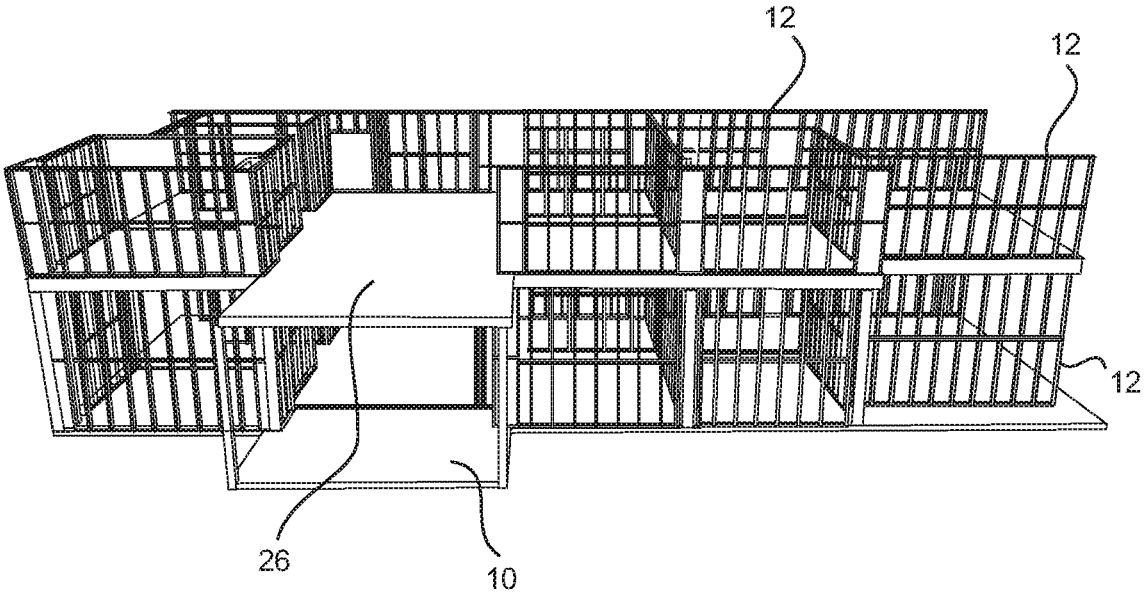

As soon as the suspended slab 26 is dry, wall frames 12 can be located atop the suspended slab 26 to form the next floor of the building. While this is occurring, work on building services such as plumbing and electricity can commence on the wall frames 10 of the lowest floor. The concrete of the slab 26 and the columns 24 will cure to their final strength over time, but during this time the load will be taken by the wall frames 12. This can be seen in FIG. 6.

The above process can be repeated for further floors.

Figure 7:
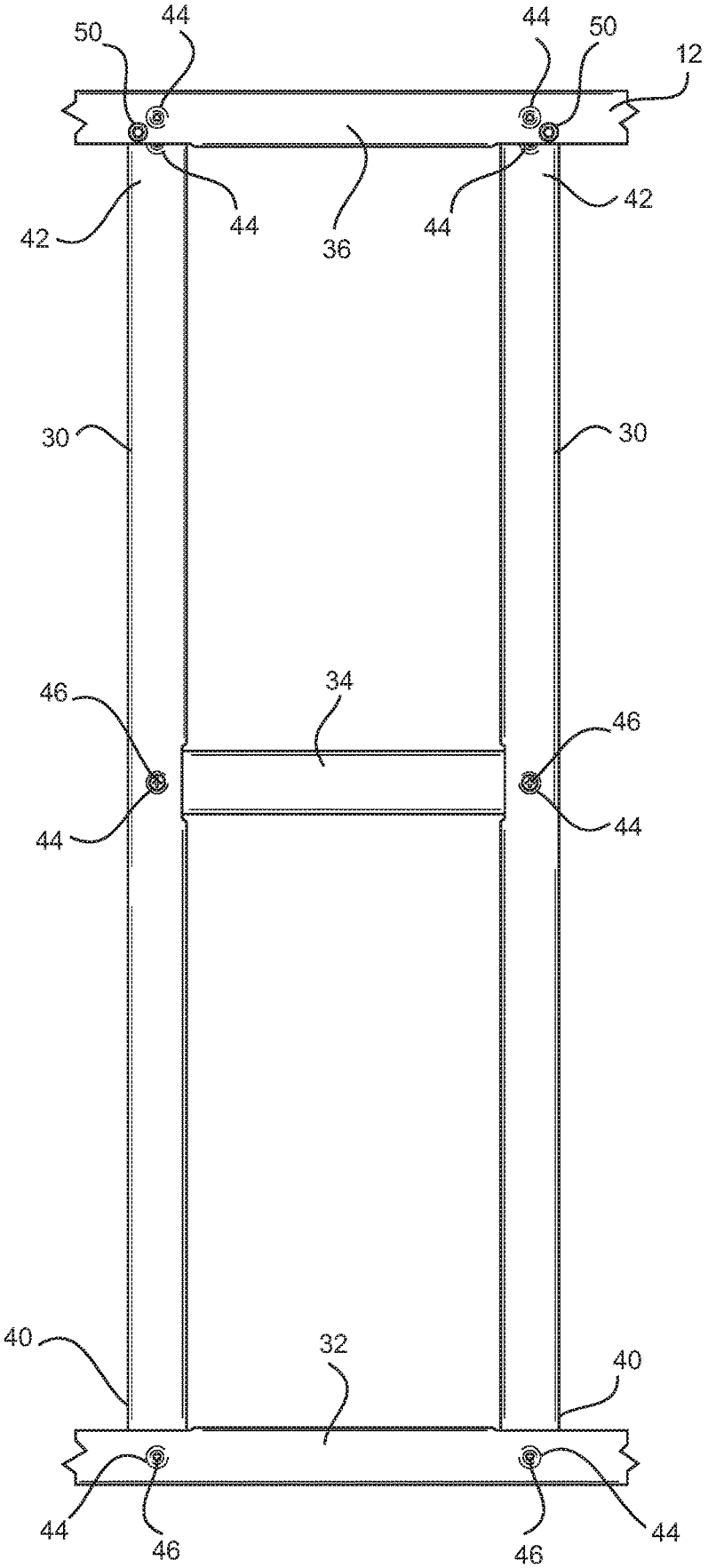
FIG. 7 is a front view of a wall frame component in accordance with the present invention.
Figure 8:
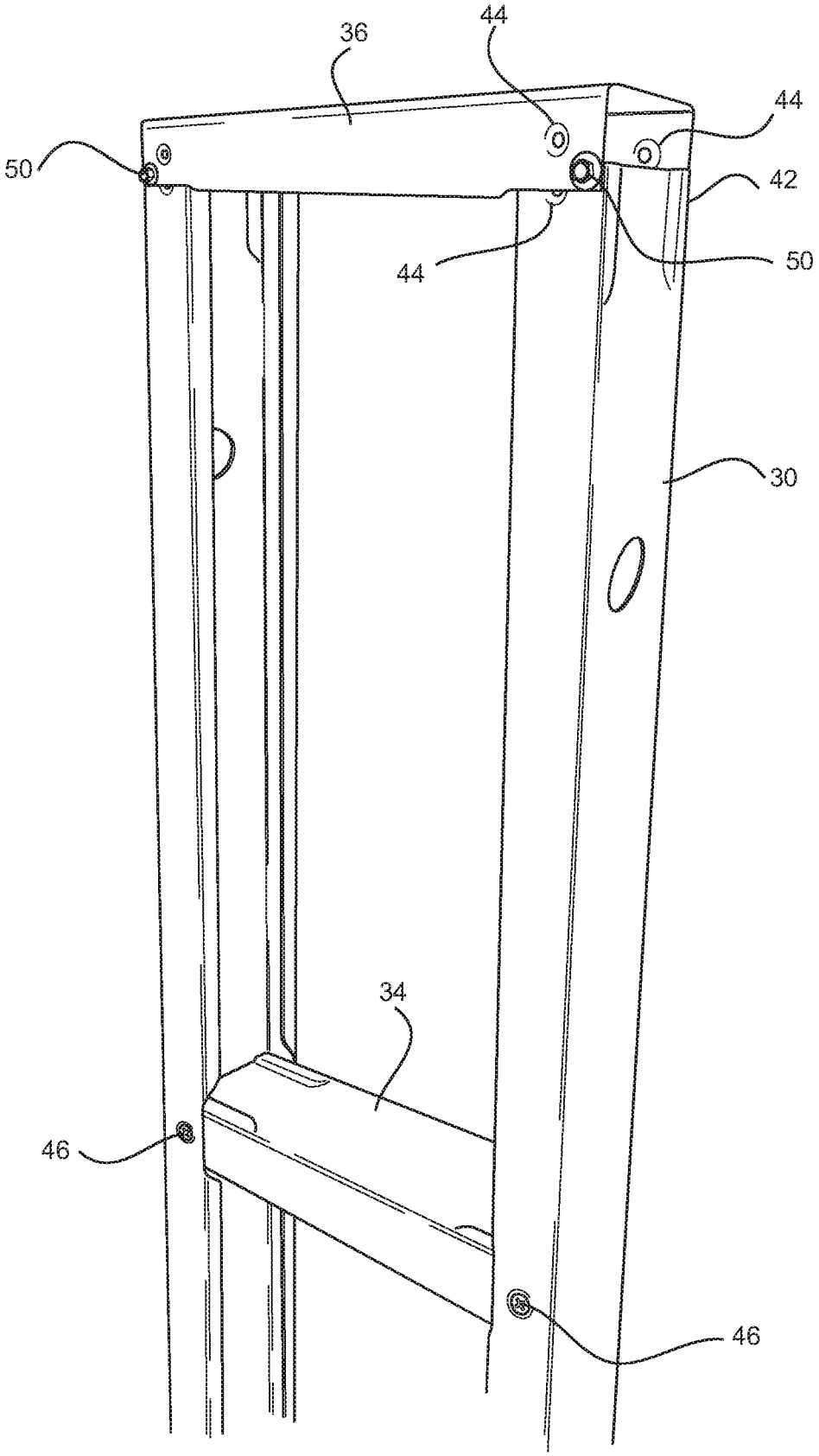
FIG. 8 is a perspective of an upper end of the wall frame component of FIG. 7.
Figure 9:
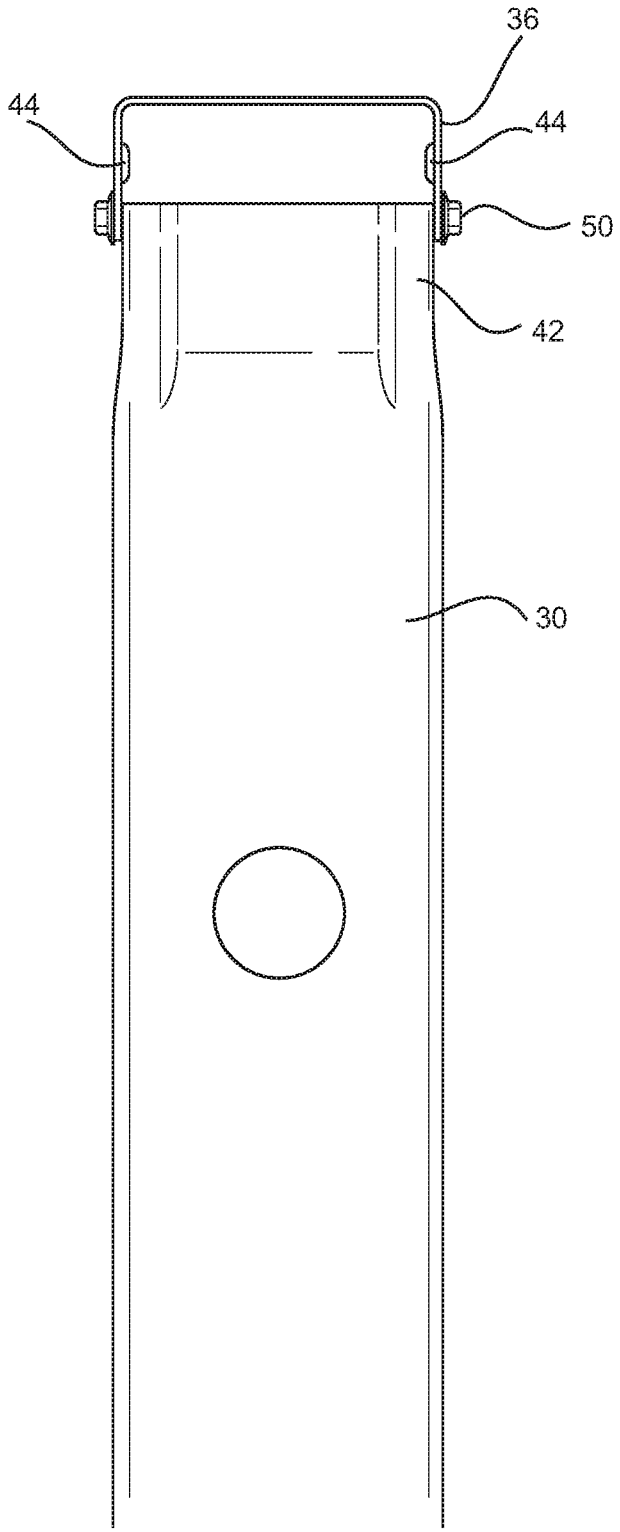
FIG. 9 is an end view of an upper end of the wall frame component of FIG. 7.

The wall frames 12 are formed from vertical studs 30 and three horizontal tracks: a base track 32, and intermediate track 34 and a top track 36. This can be seen in FIGS. 7 to 9.

The vertical studs 30 each have a lower end 40 and an upper end 42. The vertical studs are slightly crimped at the lower end 40 so as to locate within the base track 32, with the base track 32 and the vertical studs 30 being of about the same width. The lower end 40 of vertical studs 30 and the base track 32 each include screw receiving apertures 44 which are inwardly indented. In this way the base track 32 can be fixed to the vertical studs 30 by means of screws 46, which are effectively countersunk so as to provide a reasonably planar surface of the wall frame 12.

The intermediate track 34 has outer ends which are crimped so as to locate within the vertical studs 30. The arrangement is such that the outside of the intermediate track 34 is generally co-planar with the outside of the vertical studs 30.

A central region of each vertical stud 30 includes screw receiving apertures 44 which are inwardly indented, as do outer ends of the intermediate track 34. In the same way as the base track, the intermediate track 34 can be fixed to the vertical studs 30 by means of screws 46, which are effectively countersunk so as to provide a reasonably planar surface of the wall frame 12.

The top track 36 and its connection to the upper end 42 of the vertical studs 30 is largely a mirror image to that of the base track 32. The vertical studs are slightly crimped at the upper end 42 so as to locate within the top track 36, with the top track 36 and the vertical studs 30 being of about the same width. The upper end 42 of the vertical studs 30, and the top track 36, each include screw receiving apertures 44 which are inwardly indented. In this way the top track 36 could be fixed to the vertical studs 30 by means of effectively countersunk screws.

The arrangement of the top track 36 differs from that of the base track 32 by the inclusion of holding screws 50.

The arrangement where the screw receiving apertures 44 of the upper end 42 of the vertical studs 30 are aligned with those of the top track 36 represents a relatively lowered position of the top track 36. In use, the top track 36 is held in a relatively raised position, with the top track 36 being fixed to the vertical studs in this relatively raised position by the holding screws 50.

In practice, the wall frames 12 as described above are built having a top track 36 held in its raised position by the holding screws 50. This means that the weight of the suspended slab 26 passes through from the top track 36 to the vertical studs 30 through the holding screws 50. The suspended slab 26 is supported by the wall frames 12 in this fashion. The wall frames 12 thus define a load path through the top track 36, the holding screws 50 and the vertical studs 30 to the slab 10.

Once the columns 24 have cured, the holding screws 50 can be removed. Removal of the holding screws 50 allows movement of the top track 36 between its relatively raised and lowered positions, relative to the slab 26. With the removal of the holding screws 50 the vertical load of the slab 26 (and higher stories) is taken by the columns 24, with the wall frames 12 no longer being load bearing. The removal of the holding screws 50 thus creates a break in the load path defined above.

This means that, in effect, the wall frames 12 are load bearing during construction of the building, allowing for an extremely fast-paced construction. Following construction, they cease to be load bearing, with the load bearing elements being concrete as required by the building codes.

It will be appreciated that this represents a complete transfer of load from the wall frames 12 to the columns 24.

In an alternative embodiment, the holding screws 50 may be designed to shear under a particular loading, for instance the loading of two higher stories. The shearing of the holding screws 50 will serve the same purpose of transferring load from the wall frames 12.

It will be appreciated that the column shutters 16 may be non-load bearing.

Alternatively, the column shutters 16 may be formed in a similar fashion to the wall frames 12 and form part of the load bearing capacity of the wall frames 12 prior to load transfer.

Modifications and variations as would be apparent to a skilled addressee are deemed to be within the scope of the present invention.

What is claimed is:

1. A method of constructing one story in a multi-story building, the method including the steps of:

forming a building frame on a floor of the story, the frame including a plurality of vertical channels, the vertical channels extending upwards from the floor, the frame being sufficiently strong to bear load from at least one higher story, the frame defining a load path for the load of the at least one higher story;

at least partially forming the at least one higher story;

filling the channels with a curable substance;

allowing the curable substance in the channels to cure and to form columns within the building; and creating a break in the load path of the frame and thus transferring the load from the at least one higher story from the building frame to the cured columns.

2. A method of constructing one story in a multi-story building as claimed in claim 1, wherein the building frame is formed from structural steel.

3. A method of constructing one story in a multi-story building as claimed in claim 2, wherein the building frame is formed of cold-rolled section steel with a nominal thickness in between 0.75 mm and 1.6 mm.

4. A method of constructing one story in a multi-story building as claimed in claim 1, wherein the curable substance is concrete.

5. A method of constructing one story in a multi-story building as claimed in claim 1, wherein the method includes the step of locating deck formwork atop the building frame, with the channels fluidly connected to the deck formwork.

6. A method of constructing one story in a multi-story building as claimed in claim 5, wherein the step of filling the channels with the curable substance occurs at the same time as the curable substance is poured into the deck formwork to complete a floor surface above the building frame.

7. A method of constructing one story in a multi-story building as claimed in claim 1, wherein at least some internal wall frames are located at the same time that external wall frames are located.

8. A method of constructing one story in a multi-story building as claimed in claim 1, wherein the building frame includes a shear head arranged to shear at a load greater than that of a single higher story but less than the entire structure at its completed load.

9. A method of constructing one story in a multi-story building as claimed in claim 8, wherein the break in the load path is effected by allowing the shear head to shear following curing of the columns, resulting in vertical loads being taken by the columns rather than by the frame.

10. A wall frame component including vertical studs and horizontal tracks, the wall frame having a top-most track moveable between a pre-determined relatively raised fixed position and a relatively lowered position, the wall frame including removable fixing members which maintain the top-most track in its raised position, whereby removal of the fixing members allows the top-most track to move into its lowered position.

11. A wall frame component as claimed in claim 10 whereby, when the top-most track is in its relatively raised position, the wall frame component includes a load path transferring load from the top-most track to the vertical studs via at least one removable fixing member.

12. A wall frame component as claimed in claim 10, wherein the top-most track includes apertures which are arranged to align with corresponding apertures in the vertical studs when the top-most track is in its relatively lowered position.

* * * * *